US011199026B2

(12) United States Patent
Chen

(10) Patent No.: US 11,199,026 B2
(45) Date of Patent: Dec. 14, 2021

(54) MAGNETIC ANTI-THEFT DEVICE

(71) Applicant: Te-Yu Chen, Pingtung (TW)

(72) Inventor: Te-Yu Chen, Pingtung (TW)

( * ) Notice: Subject to any disclaimer, the term of this patent is extended or adjusted under 35 U.S.C. 154(b) by 739 days.

(21) Appl. No.: 16/028,447

(22) Filed: Jul. 6, 2018

(65) Prior Publication Data

US 2020/0011091 A1 Jan. 9, 2020

(51) Int. Cl.

| | |
|---|---|
| ***E05B 47/00*** | (2006.01) |
| ***G08B 13/14*** | (2006.01) |
| ***G08B 13/24*** | (2006.01) |
| ***E05B 39/00*** | (2006.01) |

(52) U.S. Cl.

CPC ..... *E05B 47/0045* (2013.01); *E05B 39/00* (2013.01); *G08B 13/149* (2013.01); *G08B 13/24* (2013.01)

(58) Field of Classification Search

CPC ..... E05B 47/0045; E05B 39/00; E05B 2047/0069; E05B 2047/0092; G08B 13/149; G08B 13/24; G08B 13/08

USPC ..... 292/251.5

See application file for complete search history.

(56) References Cited

U.S. PATENT DOCUMENTS

| | | | | |
|---|---|---|---|---|
| 7,941,934 | B2 * | 5/2011 | Gerner | E05B 49/002 33/540 |
| 9,875,586 | B2 * | 1/2018 | Reitsma | G07C 9/00706 |
| 10,627,178 | B2 * | 4/2020 | Hofleitner | F41A 17/063 |

* cited by examiner

*Primary Examiner* — John A Tweel, Jr.

(74) *Attorney, Agent, or Firm* — Leong C. Lei

(57) ABSTRACT

A magnetic anti-theft device, includes: a control circuit, in connection with a plurality of magnetic sensors and a control unit; the plurality of magnetic sensors, allowing different magnetic induction strengths to be preset; and an unlock piece, configured with a plurality of magnetic elements corresponding to the magnetic induction strengths of the plurality of magnetic sensors, whereby, when the correct unlock piece is placed on the magnetic sensors, the plurality of magnetic sensors will induct correct magnetic forces, the control unit is driven to release a monitoring state after interpretation of the control circuit; if the induction is incorrect, the control unit is driven to form a warning action after the interpretation of the control circuit so as to achieve an anti-theft effect and increase safety effectively probably because the magnetic force of the magnetic element of the unlock piece is too small or too large.

4 Claims, 5 Drawing Sheets

MAGNETIC ANTI-THEFT DEVICE

TECHNICAL FIELD OF THE INVENTION

The present invention relates to a magnetic anti-theft device, and more particularly to a magnetic anti-theft device, capable of achieving an anti-theft effect by sensing correct magnetic forces and further improving the safety effectively.

DESCRIPTION OF THE PRIOR ART

There are many thieves in a highly economically developed society due to the changes of the times. Therefore, many companies or homes are installed with anti-theft devices, thereby allowing particular persons or families to use unlock pieces to disarm alarms and process unlocking, stopping thieves, and achieving the deterrent and warning effect. Conventional anti-theft alarms for doors, windows, locks or important collection cabinets can be roughly classified into password setting type, remote control type or magnetic card type. However, the above alarms have the following disadvantages:

1. The password setting type alarms are set and released through a set of passwords; if the passwords are forgotten, the alarms will not be released and the anti-theft devices will thus not be unlocked, and the worst, they are easily cracked by thieves.
2. The remote-control type alarms are set and released by a remote controller, and they are also easily cracked by thieves.
3. The magnetic card type alarms are interpreted by means of different magnetism but designs of them are rather fixed and simple such that they are also easily cracked by thieves.

SUMMARY OF THE INVENTION

The main object of the present invention is to provide a magnetic anti-theft device, achieving an anti-theft effect and further increasing safety effectively by inducting correct magnetic forces.

To achieve the object mentioned above, the present invention proposes a magnetic anti-theft device, including: a control circuit, in connection with a plurality of magnetic sensors and a control unit; the plurality of magnetic sensors, allowing different magnetic induction strengths to be preset; and an unlock piece, configured with a plurality of magnetic elements corresponding to the magnetic induction strengths of the plurality of magnetic sensors, whereby, when the correct unlock piece is placed on the magnetic sensors, the plurality of magnetic sensors will induct correct magnetic forces, the control unit is driven to release a monitoring state after interpretation of the control circuit; if the induction is incorrect, the control unit is driven to form a warning action after the interpretation of the control circuit so as to achieve an anti-theft effect and increase safety effectively probably because the magnetic force of the magnetic element of the unlock piece is too small or too large.

According to the magnetic anti-theft device, the magnetic sensor is a magnetic induction coil having an action of inducting a magnetic strength, thereby inducting the magnetic strengths of the unlock piece for the interpretation of the control circuit.

According to the magnetic anti-theft device, the magnetic element configured in the unlock piece is a magnet having a different magnetic strength.

DETAILED DESCRIPTION OF THE PREFERRED EMBODIMENTS

Figure 1:
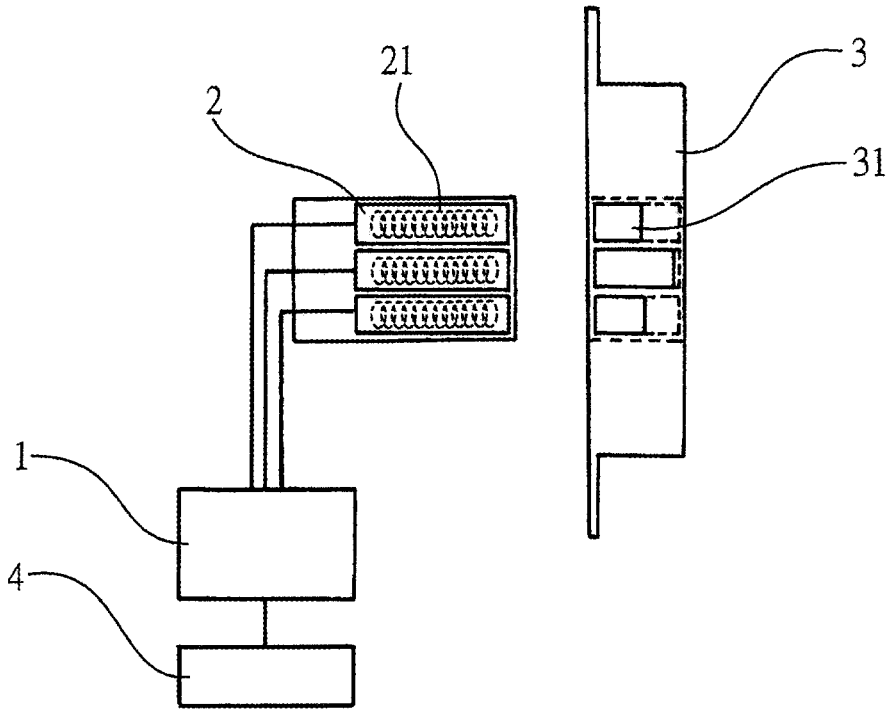
FIG. 1 is a schematic view of the present invention.

Referring to FIG. 1, a magnetic anti-theft device of the present invention includes a control circuit 1 and a plurality of magnetic sensors 2 in connection with the control circuit 1, and an unlock piece 3 corresponding to the plurality of magnetic sensors 2, where the control circuit 1 may be allowed to be in connection with a control unit 4. In a preferred embodiment, the control unit 4 may be a device such as an alarm or lock.

The magnetic sensors 2 are arranged side by side, and each of them is provided with a magnetic induction coil 21 sensing magnetic strength for different preset induction magnetic strength (different induction magnetic strength is constituted by the different magnetic induction coil 21).

The unlock piece 3 is configured with a plurality of magnetic elements 31 corresponding to the induction magnetic strengths of the magnetic sensors 2. In the embodiment, the magnetic elements 31 are magnets having different magnetic strength.

The magnetic anti-theft device of the present invention is formed by combining the above components together. The magnetic sensors 2 are installed on proper locations. Whereby, they will sense correct magnetic forces corresponding to the induction magnetic strengths when the correct unlock piece 3 is placed on the magnetic sensors 2. Therefore, the monitoring state is disarmed after the interpretation of the control circuit 1 (the control unit 4 is released to close the alarm or the unlock function is formed). Furthermore, if an incorrect magnetic force is sensed, it may be because the magnetic force of the magnetic element 31 of the unlock piece 3 is too small or too large. Thereafter, the alarm of the control unit 4 is actuated so to achieve an anti-theft effect after the interpretation of the control circuit 1, and further to enhance the safety effectively.

Figure 2:
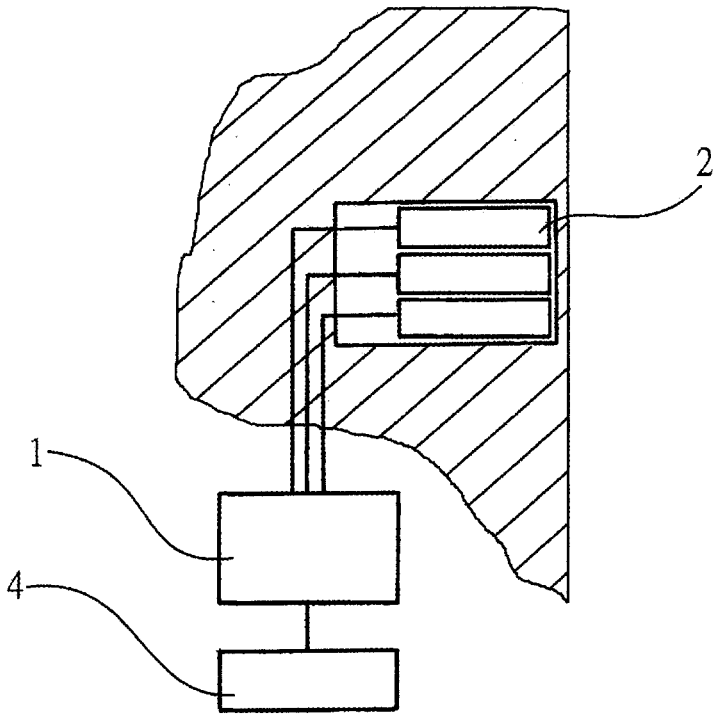
FIG. 2 is a schematic view of the present invention upon installation.

Referring to FIG. 2, the magnetic sensors 2 of the present invention, upon installation, are buried in or installed on proper locations and in connection with the control circuit 1 and control unit 4 configured on secret locations. In a normal state, the control unit 4 is kept in a standby state (the alarm is in a close and static state, and the lock is in a locking state).

Figure 3:
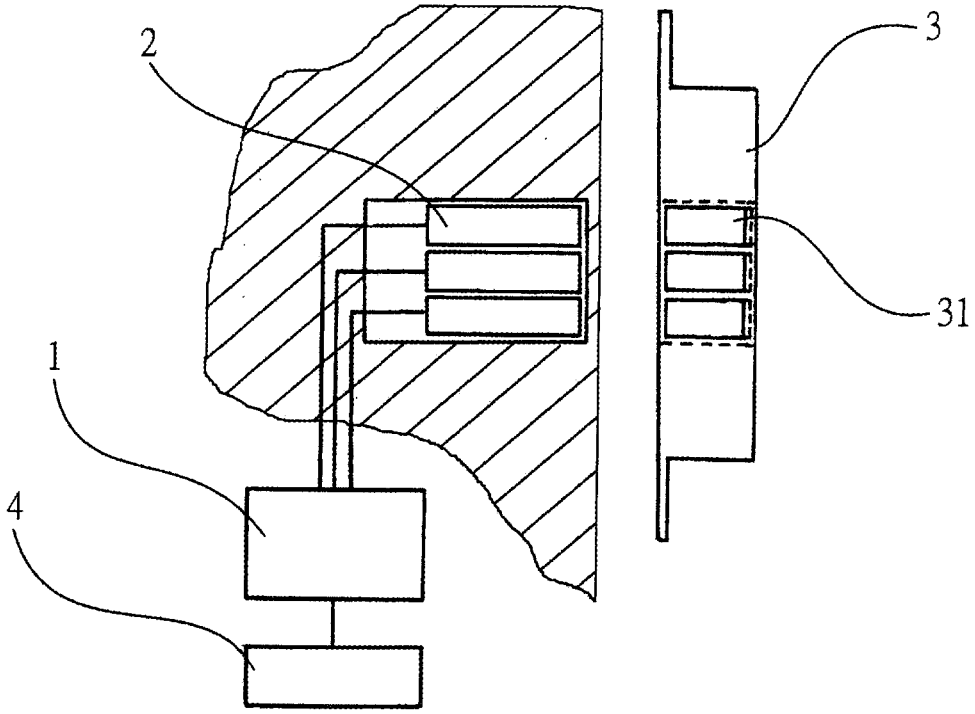
FIG. 3 is a schematic view of the present invention in an induction state.

Referring to FIG. 3, the magnetic anti-theft device of the present invention, in an induction state, will induct the magnetic sensor 2 with a magnetic object (unlock piece 3) when thieves or gangsters want to open it; provided thieves or gangsters understand the structure of magnetic sensor 2, they make an unlock piece 3 at the same time. But, the control unit 4 is driven to emit warning sound immediately through the interpretation of the control circuit 1 so as to achieve deterrence warning after the magnetic sensors are inducted because the magnetic forces of the magnetic elements of the unlock piece 3 are incorrect, and the lock will be locked and won't open if the control unit 4 is in connection with the lock, thereby achieving an anti-theft effect. In the embodiment, provided that the magnetic induction strength of the magnetic sensors are 1, 2 and 3 Gauss in sequence for example, and the magnetic strengths of the magnetic elements 31 of the unlock piece 3 held by a thief or gangster are 3, 3 and 3 Gauss in sequence for example such that the magnetic strengths of the unlock element 3 does not correspond to the magnetic induction strengths of the magnetic sensors 2; the control circuit 1 judges that the magnetic strength correspondence of the both are not correct after the induction of the magnetic sensors 2 and further drives the control unit 4 to emit warning sound or cause the lock to be kept in a locking state.

Figure 4:
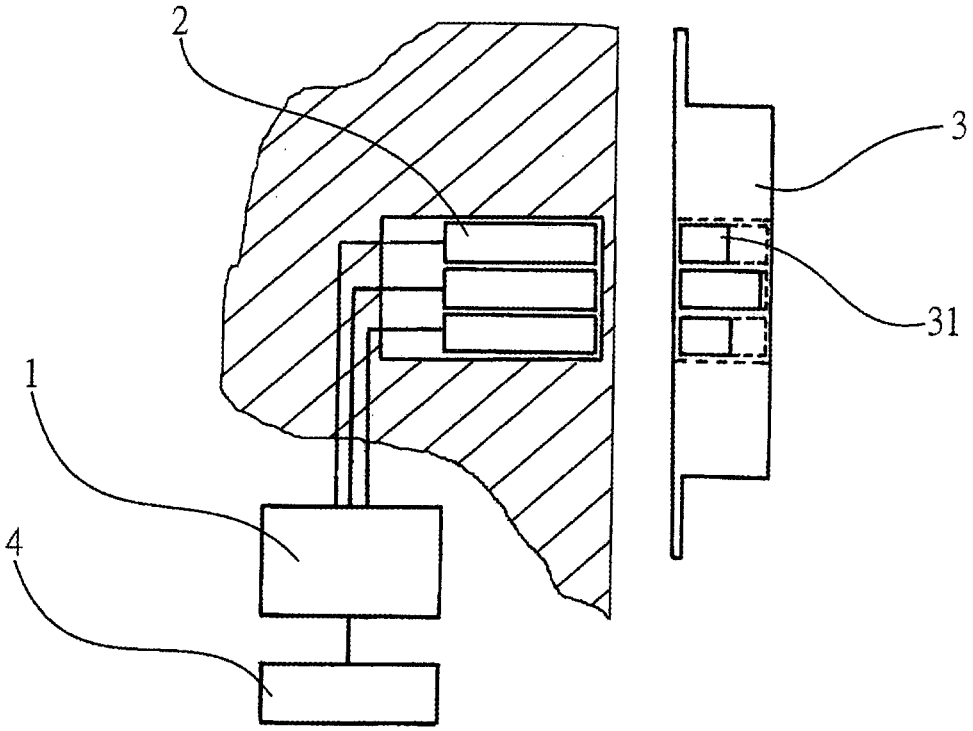
FIG. 4 is a schematic view of the present invention in another induction state.

Referring to FIG. 4, the magnetic anti-theft device of the present invention will close the control unit 4 and won't emit sound through the interpretation of the control circuit 1 and will unlock the lock at the same time when a user holds a correct unlock piece 3 to induct the magnetic sensors 2. Given that the magnetic induction strengths of the magnetic sensors 2 are 1, 2 and 3 Gauss in sequence in the embodiment for example, the magnetic strengths of the magnetic elements 31 of the unlock piece 3 held by the user are also 1, 2 and 3 Gauss in sequence such that the magnetic strengths of the unlock piece 3 correspond to the magnetic induction strengths of the magnetic sensors 2. The control circuit 1 then judges the magnetic strength correspondence is correct after the magnetic sensors 2 are inducted, and further closes the driver so that warning sound will not be emitted or unlocks the lock.

Figure 5:
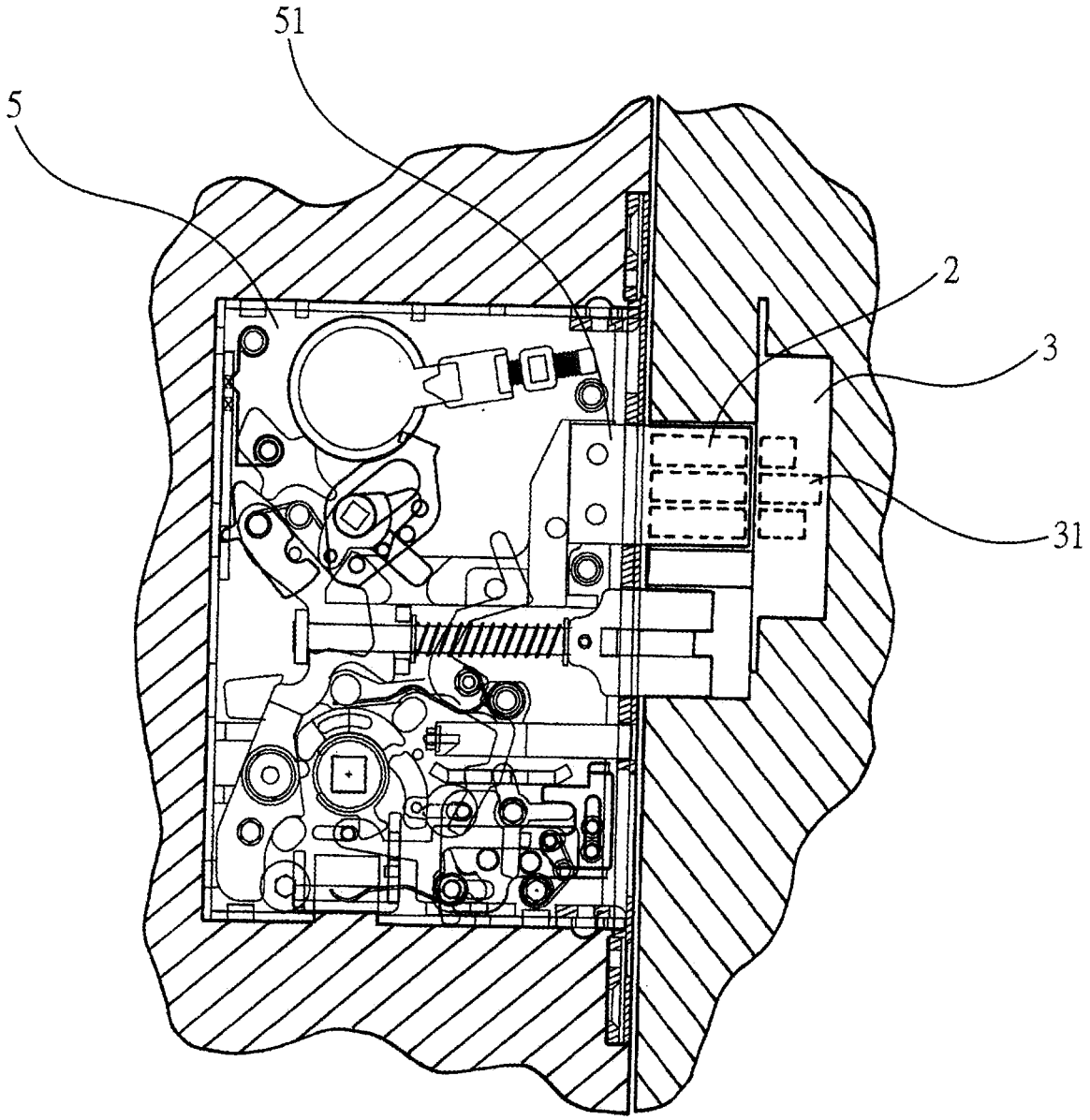
FIG. 5 is a schematic view of the present invention for another application.

Referring to FIGS. 1 and 5, the magnetic anti-theft device of the present invention can be used on a lock 5. The magnetic sensors 2 are arranged in sequence on a spring bolt 51 of the lock 5. Similarly, the corresponding unlock piece 3 can be placed on the magnetic sensors 2, which will induct the correct magnetic forces so that the lock will be unlocked after the interpretation of the control circuit. If the magnetic force inducted is not correct, the alarm of the control unit 4 will be driven to emit sound after the interpretation of the control circuit 1 and the lock 5 is kept in a locking state so as to achieve an anti-theft effect probably because the magnetic force of the magnetic element 31 of the unlock 3 is too small or too large.

To sum up, the present invention configures a plurality of magnetic sensors having different magnetic induction strength in advance and an unlock piece having a plurality of magnetic elements corresponding to the magnetic sensors to form a magnetic anti-theft device. The present invention can achieve the anti-theft effect by inducting correct magnetic force, and further can increase safety effectively.

I claim:

1. A magnetic anti-theft device, comprising:

a control circuit, in connection with a plurality of magnetic sensors and a control unit;

said plurality of magnetic sensors, allowing different magnetic induction strengths to be preset; and an unlock piece, configured with a plurality of magnetic elements corresponding to said magnetic induction strengths of said plurality of magnetic sensors, whereby, when a correct unlock piece is placed on said magnetic sensors, said plurality of magnetic sensors will induct correct magnetic forces, said control unit is driven to release a monitoring state after interpretation of said control circuit; if said induction is incorrect, said control unit is driven to form a warning action after said interpretation of said control circuit so as to achieve an anti-theft effect and increase safety because said magnetic force of said magnetic element of said unlock piece is too small or too large.

2. The device according to claim 1, wherein said magnetic sensor is a magnetic induction coil having an action of inducting a magnetic strength, thereby inducting said magnetic strengths of said unlock piece for said interpretation of said control circuit.

3. The device according to claim 1, wherein said magnetic element configured in said unlock piece is a magnet having a different magnetic strength.

4. The device according to claim 1, wherein said control unit is an alarm or lock.

* * * * *